United States Patent [19]

Fenton et al.

[11] 3,952,719

[45] Apr. 27, 1976

[54] VACUUM PULSE ACTUATED FUEL CONTROL VALVE

[75] Inventors: Robert A. Fenton, St. Louis, Mo.; Daniel L. Donovan, Decatur, Ill.

[73] Assignee: Borg-Warner Corporation, Chicago, Ill.

[22] Filed: Mar. 28, 1975

[21] Appl. No.: 563,032

[52] U.S. Cl. ..... 123/198 DB; 123/142; 123/DIG. 11; 123/139 AZ; 123/140 MP

[51] Int. Cl.[2] ..... F02B 77/00; F02M 17/00

[58] Field of Search ..... 123/198 D, 198 DB, 198 R, 123/142, 139 AU, 139 AZ, 140 MP, DIG. 11, 129; 137/479, 483

[56] References Cited

UNITED STATES PATENTS

| | | | |
|---|---|---|---|
| 1,262,013 | 4/1918 | Callon | 123/129 |
| 1,461,662 | 7/1923 | Lawamura | 123/139 AZ |
| 2,061,079 | 11/1936 | Lacop | 200/83 |
| 2,212,486 | 8/1940 | Zoder | 123/198 DB |
| 2,855,174 | 10/1958 | DeGarrio | 137/479 X |
| 3,491,737 | 1/1970 | Burnia | 123/DIG. 11 |
| 3,517,653 | 6/1970 | Ariga et al. | 123/198 DB |
| 3,606,871 | 9/1971 | Gropp et al. | 123/117 A |
| 3,618,582 | 11/1971 | Gerlitz | 123/198 DB |
| 3,620,198 | 11/1971 | Breitschwadtetal | 123/142 X |
| 3,744,471 | 7/1973 | Brauu et al. | 123/198 DB |
| 3,800,759 | 4/1974 | Cedar | 123/198 DB X |
| 3,805,760 | 4/1974 | Yagi | 123/198 DB |

*Primary Examiner*—Charles J. Myhre
*Assistant Examiner*—Ira S. Lazarus
*Attorney, Agent, or Firm*—Herman E. Smith

[57] ABSTRACT

An automatic fuel control valve useful with, rotary, as well as 2-stroke cycle and 4-stroke cycle reciprocating internal combustion engines employs a rubber-like check valve and a porous plug in combination with a chamber for averaging recurrent vacuum pulses from the engine, in which the resulting average pressure is applied to maintain a fuel valve in the open condition while the engine is running and to permit the valve to close when the engine is not running.

3 Claims, 3 Drawing Figures

61
60
62
63
19
21
10
16
23
18
22
24
64
17
12
13
11
26
36
51
52
31
14
41
42
93
29
71
32
94
96
88
86
76
84
83
78
77
74
72
82
81
70
87
79

13
14
10
1.
1.
94
96
26

10
12
27
28
19
22
23
33
54
51
34
56
13
53
52
31
41
43
41
32
37
38
39
36
92
47
14
48
44
42
29
91
46
93
94
96

VACUUM PULSE ACTUATED FUEL CONTROL VALVE

BACKGROUND OF THE INVENTION

1. Field

The present invention relates to safety devices for internal combustion engines and more particularly to an automatic fuel cut-off valve which remains open while the engine is running and closes when the engine is not running.

2. Prior art

It has been known to provide safety devices which respond to the presence or absence of engine vacuum and in some cases to provide an anti-back fire check valve and air bleed in such devices. Such devices are especially useful with 4-stroke cycle, multi-cylinder engines in which vacuum pulses from various cylinders are averaged in the engine manifold to provide an average negative pressure for operation of the device. Difficulty has been encountered in application of such prior devices to 2-stroke cycle engines and to some 4-stroke cycle engines. As a result it has become customary to provide manually operated, or electromagnetically operated fuel cut-off valves on apparatus such as motor cycles, garden tillers, grass mowers and the like. It is thought that these difficulties arise from the lack of a sustained negative pressure condition in the air intake system of the engine with which the device is used. For example, the air induction system of a single cylinder 4-stroke cycle engine may experience a subambient or negative pressure for approximately one-fourth of a cycle followed by ambient pressure for approximately three fourths of a cycle, depending somewhat upon valve timing and shape and size of induction passages. A 2-stroke cycle engine can produce alternations of sub-ambient and super-ambient pressures as the piston moves back and forth each cycle. Such variations of pressure can result in interruption of the fuel flow to the engine. While an anti-backfire valve, in theory, might be expected to function as a check valve for trapping subambient pressure, the massive movable elements in such valves may further contribute to the problem of pressure variation resulting in interrupted fuel flow, particularly where the engine is expected to operate over a range of speed from idle to wide open throttle.

SUMMARY OF THE INVENTION

The present invention is directed to improvements in automatic fuel shut off valves for use with internal combustion engines in which intermittent vacuum pulses from the engine air induction system are filtered or averaged by means of a resilient check valve and an air bleed to provide a sustained negative pressure for holding the fuel valve in the open condition while the engine is running. Preferably the check valve includes a flexible, inherently resilient member capable of responding to high frequency pulses associated with high speed engine operation. Preferably the air bleed is formed of a material having controlled porosity selected for regulating the rate of decay of negative pressure such that a negative pressure condition can be sustained during the interval between low frequency vacuum pulses associated with idle speed operation of the engine. The improved fuel valve of the present invention permits closure of the fuel supply when the engine is stopped but maintains an uninterrupted fuel supply both at low speed and high speed operation of the engine. The fuel valve is adaptable for use with single cylinder or multi-cylinder engines, and with 2-stroke cycle engines or 4-stroke cycle engines and with rotary engines.

DESCRIPTION OF THE PREFERRED EMBODIMENT

Figure 1:
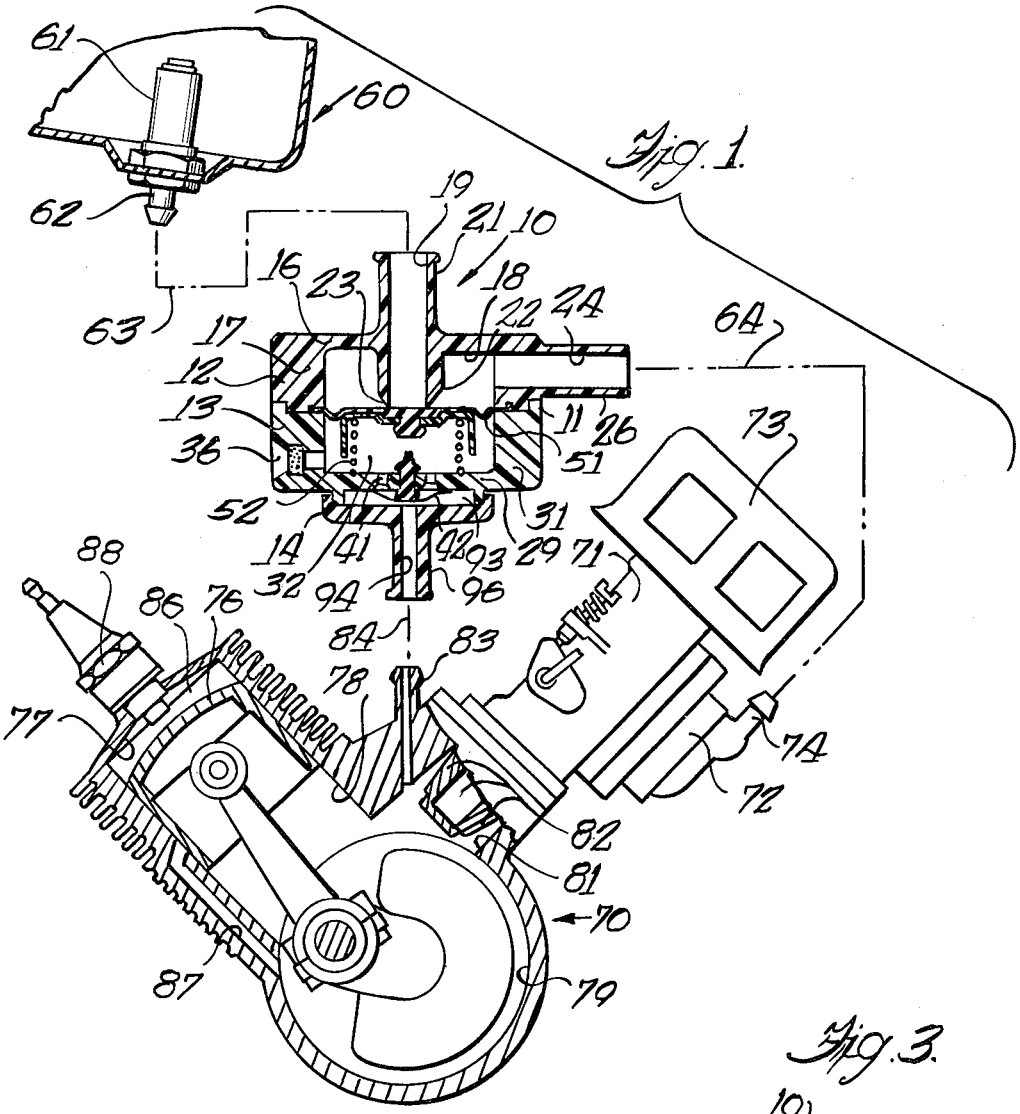
FIG. 1 is a schematic view in section of an automatic fuel cut-off valve according to the present invention connected with a fuel tank and internal combustion engine.
Figure 2:
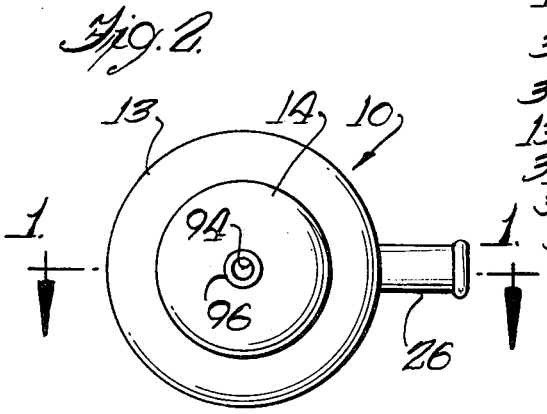
FIG. 2 is an end view of the fuel cut-off valve.
Figure 3:
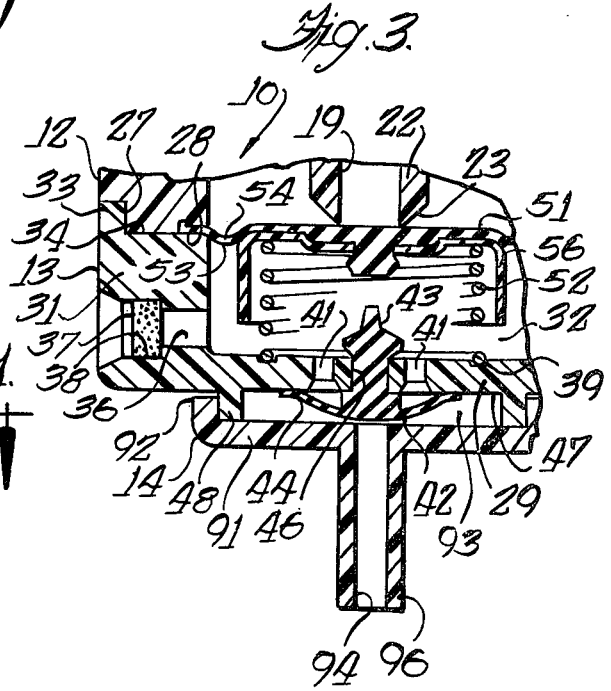
FIG. 3 is an enlarged fragmentary section view of a portion of the fuel valve.

Referring in more detail to the drawing, the reference character 10 indicates an automatic vacuum pulse actuated fuel cut-off valve. As indicated schematically in FIG. 1, the fuel valve 10 is associated with a fuel supply circuit including a fuel tank 60 and an engine 70, the tank, valve, and engine being drawn to different scale for clarity of illustration.

Fuel valve 10 includes a body 11 formed of three parts, an end shell 12, a middle shell 13 and a cover 14. End shell 12 includes an end wall portion 16, and an annular wall portion 17 defining an internal cavity 18 therein. A fuel inlet port 19 extends through end wall portion 16 defined by an external tubular extension 21 and an internal tubular extension 22. The end of internal extension 22 is beveled to form a valve seat 23. A fuel outlet port 24 extends through the annular wall portion 17 and is defined in part by an external tubular extension 26. The external tubular extensions 21 and 26 are adapted for connection in a fuel circuit as by means of flexible tubing such as rubber-like hose into which the extensions are inserted. Other forms of connection to a fuel circuit can be employed where desired. End shell 12 includes a stepped annular shoulder configuration 27 and an annular grooved configuration 28 which cooperate with portions of middle shell 13 to form an air-tight joint and for locating and securing the flexible diaphragm 51.

Middle body shell 13 includes an end wall portion 29 and an annular wall portion 31 defining in combination with diaphragm 51 an internal vacuum control chamber 32. Annular wall portion 31 includes a rim portion 33 and a face portion 34 which cooperate with end shell 12 and diaphragm 51. A vent passage 36 extends through annular wall portion 31 which permits air bleeding of control chamber 32 to ambient atmosphere. Preferably the rate of air bleeding through vent passage 36 is controlled by a porous plug 37. Such plugs are preferably formed of a granular material in which the interstices between adjacent granules form a multitude of parallel restricted passages for regulating the rate of air flow through the plug. In such plugs the compaction of the granules and/or the size of the granules can be selected to provide a predicable composite flow restriction for the plug. Thus it is possible to provide a plug socket 38 of standard size in the vent passage 36 which socket will receive any one of several interchangeable plugs having different values of flow restriction. As a result, the cut off valve can be adapted for use with various sizes and types of engines by selection and installation of a corresponding restrictor plug providing the desired composite flow restriction.

The end wall portion 29 of middle shell 13 includes an annular groove 39 for locating a biasing spring 52. One or more control apertures 41 extend through end wall portion 29. A flexible resilient check valve 42 is secured to end wall portion 29 and arranged to permit one-way flow outwardly of control chamber 32 through apertures 41 while preventing back flow through apertures 41 into control chamber 32. Preferably the check valve 42 is formed of a stretchable, resilient, flexible rubber-like material having a shape, including a stem portion 43 and a cap portion, 44 resembling a mushroom or unbrella. Such a check valve can be secured to end wall portion 29 by inserting the deformable stem portion 43 through an opening 46 such that the flexible resilient cap portion 44 covers the control apertures 41 forming a seal with face 47. A check valve having a thin rubber-like cap portion 44 is able to respond to high frequency pressure pulsations to assure that flow is unidirectional outwardly of chamber 32 through apertures 41. End wall portion 29 includes an annular shoulder 48 cooperating with cover 14.

End cover 14 includes a substantially circular wall portion 91 and lip 92 which cooperate with shoulder 48 and face 47 to define a pulse chamber 93 enclosing the cap portion 44 of check valve 42. A control port 94 extends through wall portion 91 and is defined in part by an external tubular extension 96 adapted for connection to the air intake system of an engine 70, as by flexible tubing.

Within shell-like body 11, the diaphragm 51 forms a flexible membrane having a dry side 53 defining a movable wall of control chamber 32, and a wet side 54 forming a closure with valve seat 23. A cup 56 is secured to the dry side of diaphragm 51 and provides a seat for biasing spring 52. Spring 52 normally urges diaphragm 51 into engagement with valve seat 23 thereby preventing fuel flow through inlet and outlet ports 19, 24. The diaphragm 51 is movable away from sealing engagement with valve seat 23 in response to a negative pressure condition in control chamber 32 and permits fuel flow between fuel ports 19 and 24 when such a negative or subambient pressure exists in the control chamber.

The end shell 12, middle shell 13 and cover 14 preferably are formed of a synthetic resinous or plastic material. When assembled, the lip 92 is sealed to shoulder 48 by the process of sonic welding to seal pulse chamber 93 from the atmosphere. In a similar manner the rim 33 is sealed to shoulder 27 to form an air tight seal.

A fuel supply is indicated in fragmentary section at 60 in FIG. 1 and, for example, may be a fuel tank having an internal filter element 61 communicating with an external connection 62 permitting flow from the tank into a flexible tube indicated by broken line 63. The tube 63 permits flow of fuel from fuel tank 60 to fuel inlet port 19 of cut-off valve 10 and forms a portion of a fuel circuit for engine 70. The broken line 64 indicates another flexible tube for connecting the fuel outlet port 24 of valve 10 with engine 70 and forms another portion of the fuel circuit for the engine.

The valve 10 can be adapted for use with various sizes and types of engines such as rotary or reciprocating, single or multi-cylinder, and 2-stroke or 4-stroke cycle. A single cylinder, 2-stroke cycle engine is indicated schematically in FIG. 1 for the purpose of illustrating operation of valve 10.

Engine 70 is illustrated as being equipped with a carburetor 71, fuel pump 72 and air horn 73. Fuel pump 72 is provided with a fitting 74 for connection to the fuel supply through the tubes 63, 64 and valve 10. Since the mode of operation of 2-stroke cycle reciprocating engines is well known, it is thought that a brief statement should be sufficient to illustrate cooperation with check valve 10. When piston 76 moves toward the top 77 of cylinder 78, a vacuum or negative pressure condition, also known as subambient, is created in crankcase 79 and induction passage 81. The subambient pressure condition causes reed valves 82 to open allowing a mixture of fuel and air to flow into the crankcase and at the same time creates a vacuum or subambient pulse in port 83. The subambient or negative pressure pulse is transmitted to control chamber 32 in valve 10 by means of a tube indicated at 84, control port 94, pulse chamber 93, check valve 42 and orifices 41. When piston 76 moves downwardly in cylinder 78 the air in the crankcase undergoes compression which creates a positive or superambient pressure condition in the crankcase. The positive or superambient pressure creates a positive pressure on the cap 44 of check valve 42 and at the same time transfers the fuel-air mixture from the crankcase to the upper portion 86 of cylinder 78 through port 87 for ignition by means of spark plug 88. Thus, both while the engine is undergoing cranking and after it is running, alternations of subambient and super ambient pulses are exhibited to the control port of cut-off valve 10, the time interval between successive negative or subambient pulses being determined by the speed of rotation of the engine.

The operation of fuel cut-off valve 10 will now be described in terms relating to the operation of an engine such as 70. When a negative pressure pulse is transmitted from crankcase 79 to control chamber 32, diaphragm 51 moves away from valve seat 23 permitting fuel to flow from tank 60 to fuel pump 72. Check valve 42 traps negative pressure in the control chamber and then seals the chamber from the following super ambient pressure pulse. At the same time ambient atmospheric air begins to bleed through porous plug 37 permitting the wet side 54 of diaphragm 51 to move slowly toward valve seat 23. The porosity, that is to say the restriction presented by porous plug 37 determines the rate of decay of negative pressure in control chamber 32 and therefore the maximum permissible time interval between successive negative pressure pulses required to hold the valve open. Thus the porosity of air bleed plug 37 should be selected in accordance with the slowest cranking speed desired for the engine with which the valve is used. If the engine is not started, the cutoff valve closes the fuel supply circuit automatically after cranking ceases. If the engine is started, the recurring negative pressure pulses are averaged in the control chamber providing a negative pressure condition for holding the diaphragm away from the valve seat to assure an uninterrupted fuel supply to the engine. If the engine is then stopped, the porous plug allows a controlled in-flow of air from ambient atmosphere into control chamber 32 which permits the wet side of the diaphragm to again seat against valve seat 23 and cut off the supply of fuel to the engine.

Thus, an automatic fuel cut-off valve has been described which is effective to interrupt the fuel supply to the engine when the engine is stopped or where it is rotating below the designated speed for starting, and which provides for uninterrupted fuel supply when the engine is operating within its designated speed range, the valve responding to negative pressure pulses generated in the air induction system of the engine.

What is claimed is:

1. A fuel control valve for use with an internal combustion engine having a fuel supply circuit and an air induction system subject to subambient pressure pulses while running, said valve comprising;

a body having wall portions defining a shell-like structure and including fuel inlet and outlet ports adapted for connection in said fuel supply circuit and a control port adapted for connection to said air induction system;

valve means disposed in said body arranged for controlling flow from said fuel inlet port to said fuel outlet port, said valve means being normally biased to a closed fuel port condition and being actuatable to an open fuel port condition;

a flexible diaphragm disposed within said body operatively associated with said valve means, said diaphragm forming a movable wall of a control chamber defined in part by wall portions of said body, said diaphragm being movable in response to subambient pressure in said control chamber for actuating said valve means to said open fuel port condition;

a restricted vent passage disposed in a wall portion of said body communicating said control chamber with ambient atmosphere; and a flexible resilient one-way check valve disposed between said control chamber and said control port arranged for permitting flow from said control chamber, said restricted vent passage and said flexible resilient check valve providing means for sustaining a subambient pressure condition in said control chamber in response to recurrent subambient pressure pulses in said control port, whereby said fuel inlet and outlet ports are maintained in communication with each other while said engine is running.

2. A fuel control valve according to claim 1, wherein said vent passage includes a porous plug secured therein forming a restriction selected for regulating the rate of decay of negative pressure in said control chamber.

3. A fuel control valve according to claim 2, wherein said vent passage includes a plug socket adapted for receiving an interchangeable porous plug.

* * * * *